US005239725A

United States Patent [19]

White

[11] Patent Number: 5,239,725

[45] Date of Patent: Aug. 31, 1993

[54] CAULKING TOOL

[76] Inventor: William A. White, 3128 Lake Washington Rd., #236, Melbourne, Fla. 32934

[21] Appl. No.: 783,380

[22] Filed: Oct. 28, 1991

[51] Int. Cl.[5] ..... E04G 21/20; B29C 37/00

[52] U.S. Cl. ..... 15/105.5; 15/105; 15/245; 15/245.1; 425/458

[58] Field of Search ..... 15/105.5, 245, 235.3, 15/236.05, 236.09, 104 S, 105, 245.1; 7/105; 425/458

[56] References Cited

U.S. PATENT DOCUMENTS

D. 221,244 7/1971 Lawrence ..... 15/236.07 X 3,351,969 11/1967 Cline ..... 15/245

4,586,890 5/1986 Marchbanks ..... 425/458

4,698,870 10/1987 Clark ..... 15/105.5

5,075,916 12/1991 Englehart ..... 15/104 S

*Primary Examiner*—Edward L. Roberts

*Attorney, Agent, or Firm*—Saliwanchik & Saliwanchik

[57] ABSTRACT

A caulking tool of flat, square-shaped plastic having each of its four corners rounded to form four different radii. The caulking tool is used after caulking material is applied to create a compacted, smooth, uniform bead. It is unique in its method of use and the choice of four different radii offering four choices of bead size from one tool.

5 Claims, 1 Drawing Sheet

CAULKING TOOL

BACKGROUND OF THE INVENTION

1. Field of the Invention

The present invention relates to the field of caulking tools and their use for creating uniform caulking beads.

2. Summary of the Invention

The subject invention is a caulking tool which measures two and one-half inches square and is between 1/32 and ¼ inches in thickness and is made of plastic. The caulking tool invention is used after caulking material is applied to create a compacted, smooth, uniform bead. It is unique in its method of use and the choice of four different radii offering four choices of bead size from one tool.

DETAILED DESCRIPTION OF THE INVENTION

The caulking tool is a two and one-half inch square made from plastic and measures between 1/32 to ¼ inches in thickness. It has four rounded corners having four different radii; one in each corner of the tool, to wit:

Radius #1: will vary from 1/32" to 5/64"
Radius #2: will vary from3/32" to 9/64"
Radius #3: will vary from 4/32" to 11/64"
Radius #4: will vary from 5/32" to 19/64".

The disclosed caulking tool is produced using a male/female steel cutting die that cuts the caulking tool in the desired configurations from sheets measuring eight feet by three inches, or, alternatively, is made by injection mold procedures using polyvinylchloride (PVC) or a like plastic material such as polypropylene.

It is known in the art that these plastics are similar in their resilience and that any such resilient material can be substituted therefor.

Figure 1:
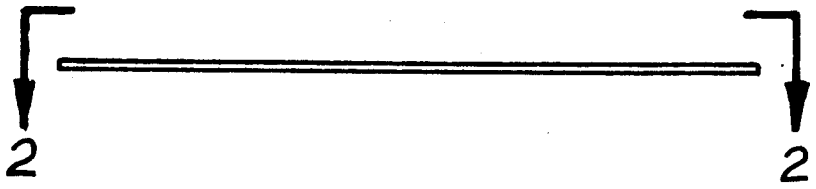
FIG. 1 shows a side view of the described caulking tool.
Figure 2:
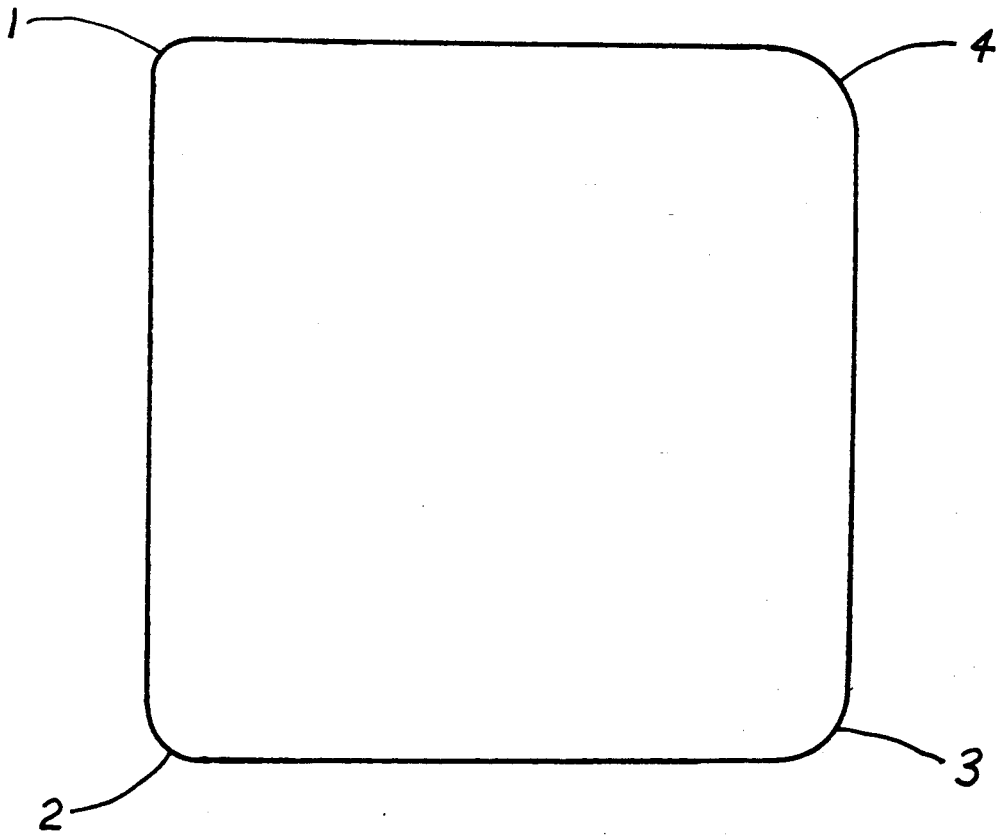
FIG. 2 shows a front view of the described caulking tool illustrating the different sizes of radii for each of the four corners.

The caulking tool is used after caulking material is applied to a seam; the tool is held at a slight angle perpendicular to the seam, with the tool side and bottom against the seam. Then, the tool is drawn toward the applier by hand. Any of four different radii may be chosen depending upon the desired bead size. Excess caulking material is removed simultaneously with bead completion, resulting in a clean, uniform, impacted bead in the seam. Disclosed herein is a caulking tool having radii of 3/32, 7/64, 11/64, and 15/64 inches, respectively, at each of its four corners (FIG. 1). The tool is unique because of the method of use and the four different radii offering four choices of bead size from one tool. An inherent advantage resulting from the straight edges of the caulking tool is its capability of being steadily supported while forming uniform, smooth caulking beads.

I claim:

1. A caulking tool for uniformly smoothing and impacting caulking, comprising a substantially flat square of resilient material having four straight sides and four rounded corners, wherein each of said four rounded corners has a different radius, each said radius measuring between 1/32 inches and 19/64 inches.

2. The caulking tool, according to claim 1, wherein said radii of said rounded corners are:

Radius #1, from 1/32 inch to 5/64 inch;
Radius #2, from 3/32 inch to 9/64 inch;
Radius #3, from 4/32 inch to 11/64 inch; and
Radius #4, from 5/32 inch to 19/64 inch.

3. The caulking tool, according to claim 1, wherein said four corners have radii measuring 3/64, 7/64, 11/64, and 15/64 inches, respectively.

4. The caulking tool, according to claim 1, wherein said resilient material is plastic.

5. The caulking tool, according to claim 4, wherein said plastic is PVC.

* * * * *